US011376187B2

(12) United States Patent
Zhao

(10) Patent No.: US 11,376,187 B2
(45) Date of Patent: Jul. 5, 2022

(54) PERCUSSIVE MASSAGE DEVICE

(71) Applicant: Xiamen High Top Electronic Technology Co., Ltd., Xiamen (CN)

(72) Inventor: Liangsan Zhao, Xiamen (CN)

(73) Assignee: Xiamen High Top Electronic Technology Co., Ltd., Xiamen (CN)

( * ) Notice: Subject to any disclaimer, the term of this patent is extended or adjusted under 35 U.S.C. 154(b) by 372 days.

(21) Appl. No.: 16/751,179

(22) Filed: Jan. 23, 2020

(65) Prior Publication Data

US 2021/0196562 A1 Jul. 1, 2021

(30) Foreign Application Priority Data

Dec. 27, 2019 (CN) ..... 201911373584.6

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/0153* (2013.01); *A61H 2201/1215* (2013.01); *A61H 2201/1664* (2013.01)

(58) Field of Classification Search
CPC .. A61H 23/006; A61H 23/0254; A61H 23/00; A61H 23/0263; A61H 2201/1664; A61H 2201/1215; A61H 2201/0153; A61H 2201/1685; A61H 2201/0107; A61H 2201/1669; A61H 1/008; A61H 1/006; A61H 1/00; A61H 15/0078; A61H 15/0085; A61B 17/14; A61B 17/16; B23B 45/00; B23B 45/02
USPC ..... 601/107–111, 112, 113, 118–125, 601/128–132
See application file for complete search history.

(56) References Cited

U.S. PATENT DOCUMENTS 10,993,874 B1 * 5/2021 Marton ..... A61H 23/006
11,253,423 B1 * 2/2022 Williams ..... A61H 23/0254
2010/0137907 A1 * 6/2010 Tsai ..... A61H 23/00 606/238
2019/0159961 A1 * 5/2019 Chuang ..... A61H 1/008
2019/0365598 A1 * 12/2019 Qu ..... A61H 15/0085
(Continued)

*Primary Examiner* — Justine R Yu
*Assistant Examiner* — Kelsey E Baller
(74) *Attorney, Agent, or Firm* — Bayramoglu Law Offices LLC

(57) ABSTRACT

A percussive massage device, including a massage head, a base and a motor, the massage head is fastened and connected to the base, and further including an eccentric wheel, an eccentric bracket, a movable member and an elastically deformable guider. The base, the guider and the movable member are arranged from the front to the rear in sequence and are fixedly connected. The movable member is provided with a supporting shaft. The motor, the eccentric wheel and the eccentric bracket are linked arranged in sequence. The eccentric bracket is provided with a first mounting hole at the front end. The supporting shaft penetrates into the first mounting hole through a first bearing. Since the base and the massage head can move horizontally forward or backward, and the guider elastically deforms forward or backward at the same time, thereby the human body can be quickly and gently massaged by tapping.

9 Claims, 7 Drawing Sheets

(56) References Cited

U.S. PATENT DOCUMENTS

2020/0276079 A1* 9/2020 Cheng ..... A61H 23/0263
2021/0128402 A1* 5/2021 Dai ..... A61H 1/00

* cited by examiner

PERCUSSIVE MASSAGE DEVICE

CROSS REFERENCE TO RELATED APPLICATIONS

This application is based upon and claims priority to Chinese Patent Application No. 201911373584.6, filed on Dec. 27, 2019, the entire contents of which are incorporated herein by reference.

TECHNICAL FIELD

The present disclosure relates to the technical field of equipment for tap massage, in particular to a percussive massage device.

BACKGROUND

The percussive massage device is a tool to help stretch recovery after exercise, which is widely used by professional athletes and amateur bodybuilders. Vibration massage mainly massages large muscle groups, relaxes fascia, reduces soreness, and makes training more effective. Both professional athletes and amateur bodybuilders have experienced muscle soreness, by using a percussive massage device, the vibration generated by the percussive massage device can relieve muscle spasm, increase blood flow and shorten the time of muscle recovery.

SUMMARY

The object of the present disclosure is to provide a percussive massage device with novel structure.

In order to achieve the above object, the present application provides a percussive massage device, including a massage head, a base and a motor and the massage head is fastened and connected to the base, and further including an eccentric wheel, an eccentric bracket, a movable member and an elastically deformable guider; the base, the guider and the movable member are arranged from the front to the rear in sequence and are fixedly connected; the movable member is provided with a supporting shaft, the motor, the eccentric wheel and the eccentric bracket are linked arranged in sequence, the eccentric bracket is provided with a first mounting hole at the front end, the supporting shaft penetrates into the first mounting hole through a first bearing.

Based on the percussive massage device having the above structure, during operation, the motor drives the eccentric wheel and the eccentric bracket to rotate, and the eccentric bracket outputs fast eccentric rotation, to pull or push the movable member to move horizontally forward or backward, so that the base and the massage head are moved horizontally forward or backward, and the guider elastically deforms forward or backward at the same time, thereby the human body can be quickly and gently massaged by tapping.

Figure 1:
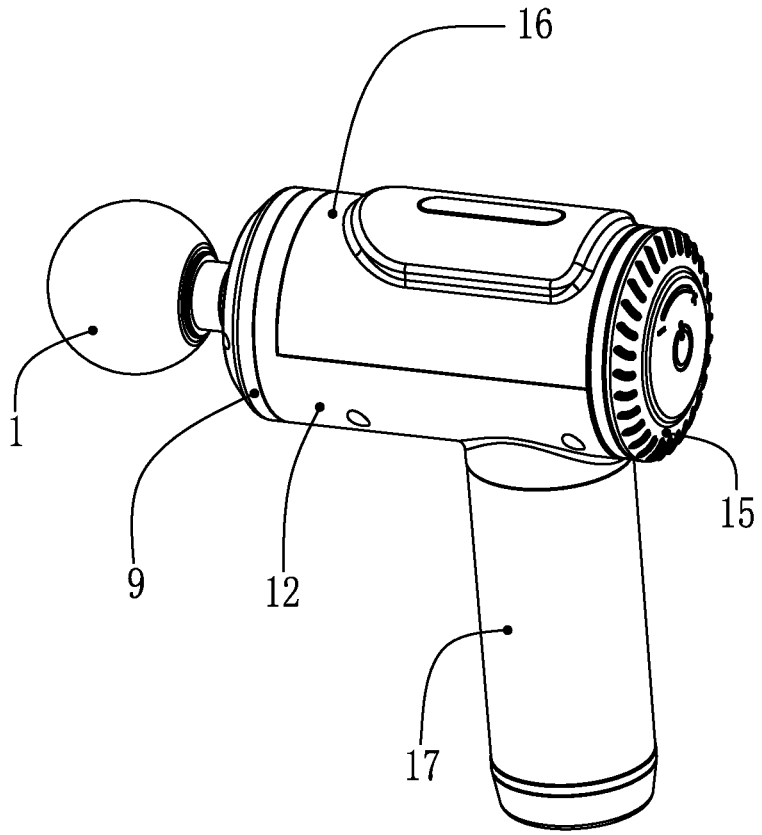
FIG. 1 is a perspective view of a percussive massage device according to the present disclosure.

wherein, the components indicated by the reference numerals are shown as follows:

F percussive massage device, 1 massage head, 2 base, 21 protruding ring, 3 motor, 4 eccentric wheel, 5 eccentric bracket, 6 movable member, 7 guider, 8 fixing sleeve tube, 9 head cover, 10 rubber guide ring, 11 rubber press ring, 12 housing, 13 PCB circuit board, 14 guide aperture, 15 rotation button casing, 16 upper housing, 17 lower housing, 18 silicone gloves, 30 fastener, 51 first mounting hole, 52 second mounting hole, 61 supporting shaft, 62 connecting shaft, 63 shading plate, 64 bottom plate, 71 guide ring, 72 mounting ring, 73 elastic rib, 81 baffle plate, 91 folded edge, 101 groove, 102 convex edge.

DETAILED DESCRIPTION OF THE EMBODIMENTS

Hereinafter, the embodiments of the present disclosure will be described in detail. Examples of the embodiments are shown in the drawings, wherein the same or similar reference numerals indicate the same or similar elements or elements having the same or similar functions. The embodiments described below with reference to the drawings are exemplary and are intended to explain the present disclosure, but should not be construed as a limitation to the present disclosure.

Figure 2:
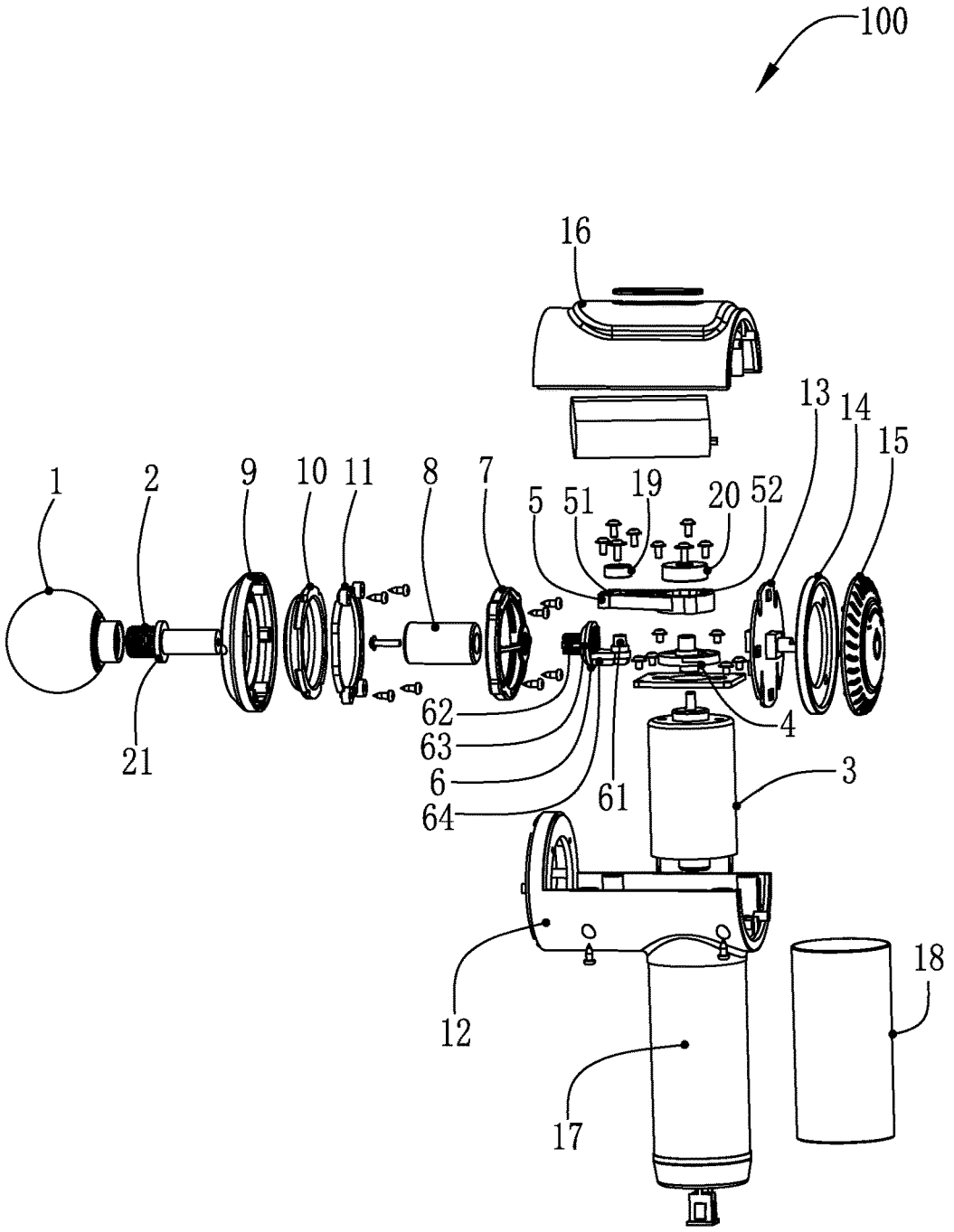
FIG. 2 is an exploded view of the percussive massage device according to the present disclosure.
Figure 3:
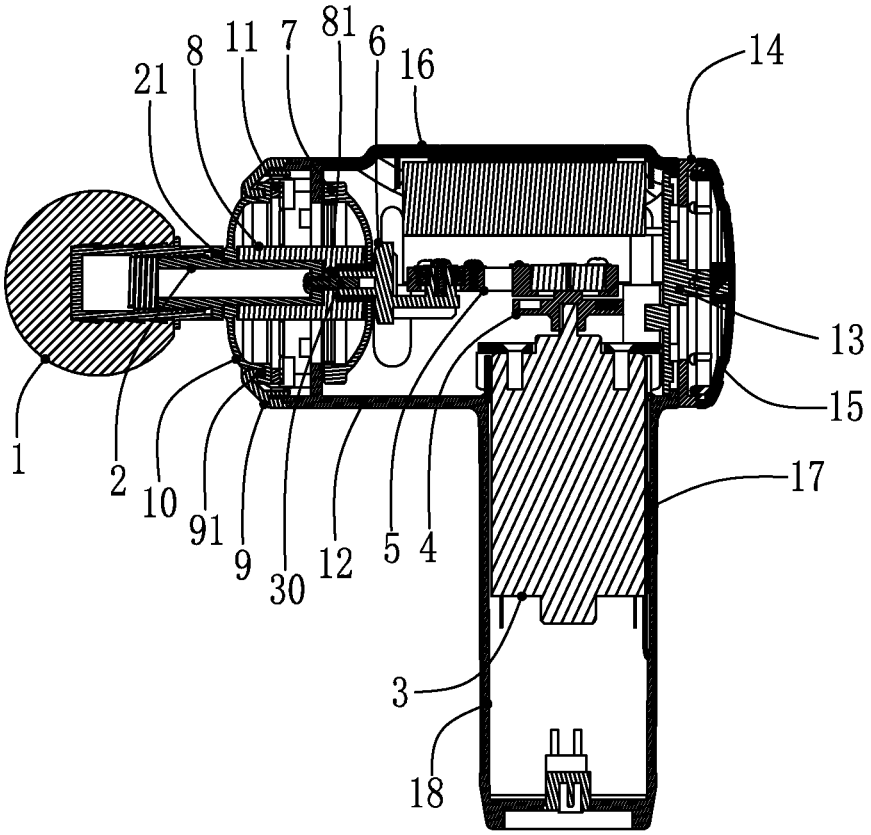
FIG. 3 is a cross-sectional view of the percussive massage device according to the present disclosure.

Please refer to FIGS. 1-3. A percussive massage device F includes a massage head 1, a base 2, a motor 3, an eccentric wheel 4, an eccentric bracket 5, a movable member 6, an elastically deformable guider 7, a fixing sleeve tube 8, a head cover 9, a rubber guide ring 10, a rubber press ring 11, a housing 12, a PCB circuit board 13, a guide aperture 14, a rotation button casing 15, a upper housing 16, a lower housing 17 and silicone gloves 18, etc. The massage head 1 and the base 2 are fixedly connected. The outer wall of the front portion of the base 2 expands outward to form a protruding ring 21. The front end surface of the rubber guide ring 10 described below is snapped on the protruding ring 21. When the base 2, the massage head 1 and the movable member 6 are moving horizontally, the rubber guide ring 10 will be snapped between the fixing sleeve tube 8 and the protruding ring 21 described below, restricting its further forward movement, which plays a limit effect.

Please refer to FIG. 2-3, the base 2, the guider 7 and the movable member 6 are arranged from the front to the back in sequence and are fixedly connected in order, and the motor 3, the eccentric wheel 4 and the eccentric bracket 5 are linked and arranged in sequence; the movable member 6 includes a supporting haft 61, a connecting shaft 62, a shading plate 63 and a bottom plate 64. The supporting shaft 61 is erected at one end of the bottom plate 64, and the shading plate 63 is integrally connected between the other end of the bottom plate 64 and the connecting shaft 62. The front end of the eccentric bracket 5 is provided with a first mounting hole 51, and the supporting shaft 61 penetrates into the first mounting hole 51 through a first bearing 19. The connecting shaft 62 penetrates through the center of the guider and penetrates into the rear end of the fixing sleeve tube 8. A baffle plate 81 is provided at the inner rear end of the fixing sleeve tube 8. The rear end of the base 2 is a closed end, and the inside thereof is a hollow structure. The rear end of the base 2 is inserted into the fixing sleeve tube 8, and a fastener 30 penetrates through the closed end of the base 2, the baffle plate 81 of the fixing sleeve tube 8, and the connecting shaft 62 in sequence from the front to the back to realize a fixed connection of the base 2, the fixing sleeve tube 8 and the connecting shaft 62. The rear end of the eccentric bracket 5 is provided with a second mounting hole 52, and the eccentric wheel 4 penetrates into the second mounting hole 52 through a second bearing 20. The motor drives the eccentric wheel at a rotation setting.

Figure 6:
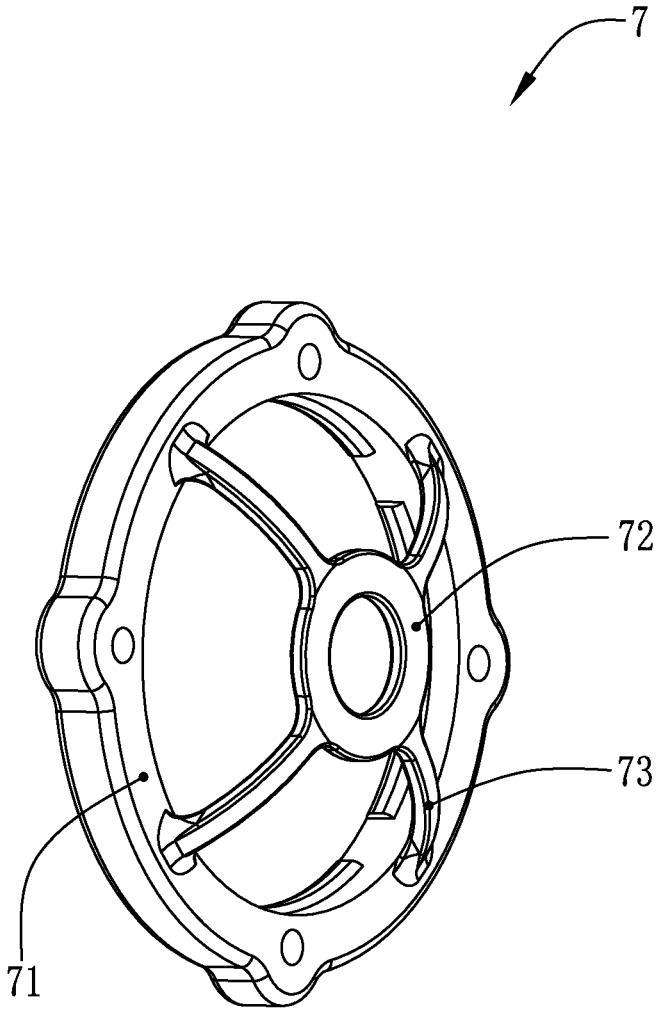
FIG. 6 is a schematic structural view of a guider of the present disclosure.

Please refer to FIG. 2 and FIG. 6, the guider 7 includes a guide ring 71 and a mounting ring 72 provided from the front to the rear, and the shading plate 63 abuts and covers the rear end surface of the mounting ring. The guide ring 71 and the mounting ring 72 are concentric circles, and a plurality of elastically deformable elastic ribs 73 are provided between the guide ring 71 and the mounting ring 72. The elastic ribs 73 are curved ribs that are bent upward, and the process is simple. In the arrangement of the shading plate 63, when the base 2, the massage head 1, and the fixing sleeve tube 8 are moved backward in horizontal for a certain displacement, the rear end surface of the guider 7 will be snapped on the shading plate 63, restricting its further backward movement, which plays a limit function. At the same time, the guider 7 is elastically deformed under the pressing of the shading plate 63. The material of the guider 7 is a TPEE (thermoplastic polyester elastomer), a block copolymer containing a polyester hard segment and a polyether soft segment. This material makes the elastic deformation of the guider 7 better. When the guider 7 is pressed forward, the elastic ribs 73 are elastically deformed backward. When the guider 7 is pulled backward, the elastic ribs 73 are elastically deformed forward. The design of the guider 7 does not require high precision, thereby the cost is effective saved.

Figure 7:
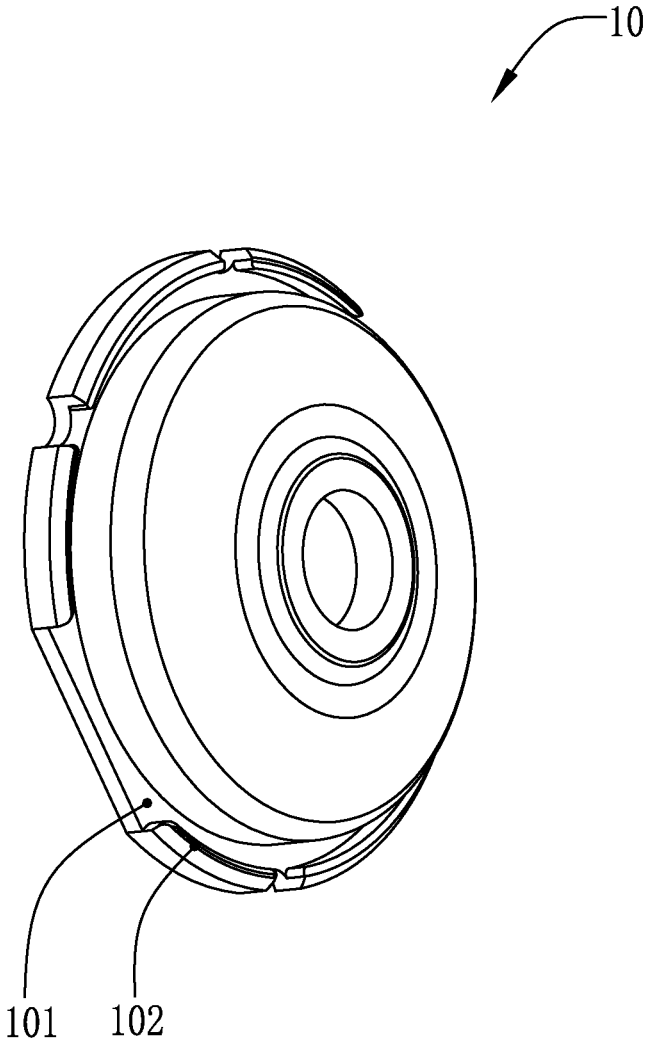
FIG. 7 is a schematic structural diagram of a rubber guide ring according to the present disclosure.

Please refer to FIG. 2 and FIG. 7, the front end surface of the head cover 9 is an opening structure, and the front end surface of the head cover 9 is provided with a folded edge 91 that is bent inwardly at the opening structure. The rear end portion of the rubber guide ring 10 is formed with a groove 101 and a convex edge 102. The front end portion of the rubber guide ring 10 penetrates out of the front end surface of the head cover 9 from the back to the front, and the folded edge 91 is inserted into the groove 101 and buckled with the convex edge 102. The rubber press ring 11 is provided behind the rubber guide ring 10, and the head cover 9, the rubber guide ring 10 and the rubber press ring 11 are fixedly connected. The head cover 9 is fixedly connected to the housing 12, and the head cover 9, the rubber guide ring 10, the rubber press ring 11, and the housing 12 are sleeved on the fixing sleeve tube 8. When the base 2, the massage head 1, and the fixing sleeve tube 8 and the movable member 6 are moved forward and backward horizontally for a certain displacement, the rubber guide ring 10 will also generate elastic deformation, so that the massage head 1 can better perform tap massage on the human body.

Figure 4:
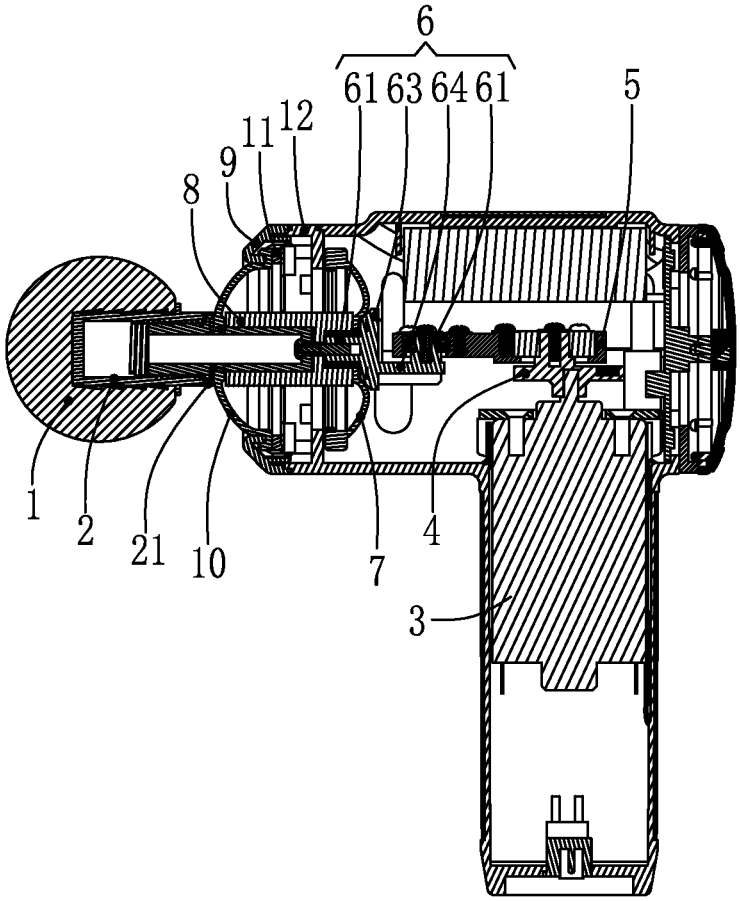
FIG. 4 is a schematic view showing the percussive massage device of the present disclosure in the first usage state.
Figure 5:
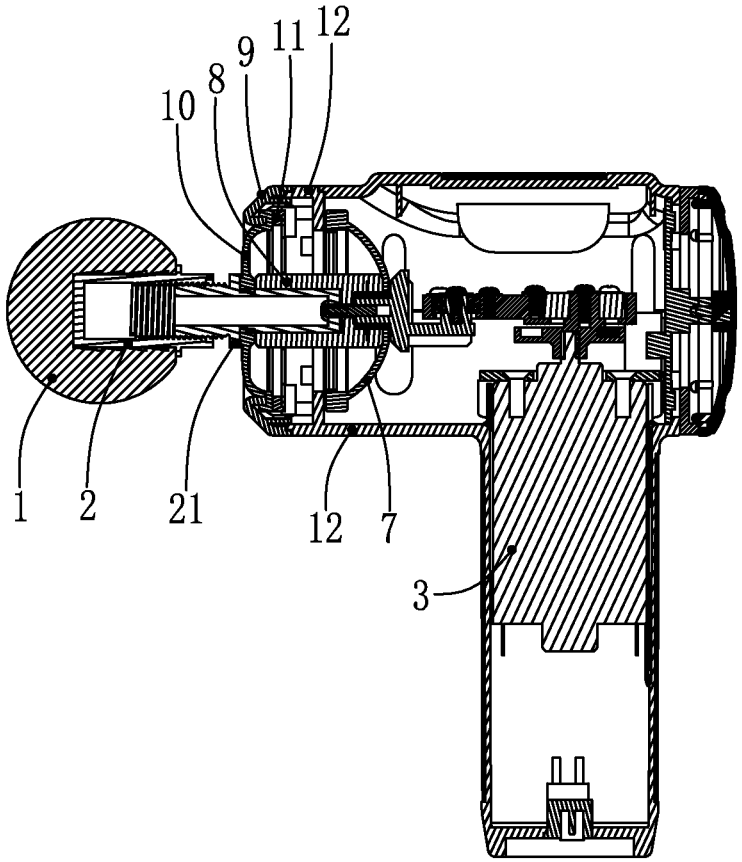
FIG. 5 is a schematic view showing the percussive massage device of the present disclosure in the second usage state.

Please refer to FIGS. 3-5, when the present disclosure is used, the motor 3 drives the eccentric wheel 4 and the eccentric bracket 5 to rotate, and the eccentric bracket 5 outputs fast eccentric rotation. Because the supporting shaft 61 of the movable member 6 penetrates into the first mounting hole 51 of the eccentric bracket 5, the movable member 6 will be pulled or pushed horizontally forward or backward when the eccentric bracket 5 rotates fast, so that the base 2, the massage head 1 and the fixing sleeve tube 8 are moved horizontally forward or backward. At the same time, the guider 7 and the rubber guide ring 10 are elastically deformed forward or backward, so that the human body can be quickly and gently massaged by tapping.

Herein, only preferred embodiments of the disclosure are described, and the scope to be claimed cannot be limited thereto. Thus, any equivalent change to the embodiments still falls within in the scope covered by the claims.

What is claimed is:

1. A percussive massage device, comprising a massage head, a base and a motor, and the massage head is fixedly connected to the base, and further comprising an eccentric wheel, an eccentric bracket, a movable member and an elastically deformable guider; the base, the guider and the movable member are arranged from the front to the rear in sequence and are fixedly connected; the movable member is provided with a supporting shaft, the motor, the eccentric wheel and the eccentric bracket are linked and arranged in sequence, the eccentric bracket is provided with a first mounting hole at a front end, the supporting shaft penetrates into the first mounting hole through a first bearing; the eccentric bracket is rotatably connected with the supporting shaft of the movable member through the first bearing, the eccentric wheel is driven by the motor to drive the eccentric bracket, so that the movable member is moved in front and back directions.

2. The percussive massage device according to claim 1, wherein the guider comprises a guide ring and a mounting ring provided from front to back, the guide ring and the mounting ring are concentric circles, and a plurality of elastically deformable elastic ribs are provided between the guide ring and the mounting ring.

3. The percussive massage device according to claim 2, wherein the elastic rib is a curved rib.

4. The percussive massage device according to claim 2, wherein the material of the guider is a thermoplastic polyester elastomer.

5. The percussive massage device according to claim 2, further comprising a fixing sleeve tube, and a baffle plate is provided at an inner rear end of the fixing sleeve tube;

the movable member is provided with a connecting shaft that penetrates through a center of the guider and penetrates into the rear end of the fixing sleeve tube;

a rear end of the base is a closed end, and an interior of the rear end of the base is a hollow structure; the rear end of the base is inserted into the fixing sleeve tube, a fastener penetrates through the closed end of the base, the baffle plate of the fixing sleeve tube, and the connecting shaft from the front to the rear, to achieve a fixed connection of the base, the fixing sleeve tube and the connecting shaft.

6. The percussive massage device according to claim 5, wherein the movable member further comprises a shading plate and a bottom plate, the supporting shaft is erected at one end of the bottom plate, and the shading plate is integrally connected between the other end of the bottom plate and the connecting shaft, the shading plate abuts and covers a rear end surface of the mounting ring.

7. The percussive massage device according to claim 1, wherein a rear end of the eccentric bracket is provided with a second mounting hole, and the eccentric wheel penetrates into the second mounting hole through a second bearing; the motor drives the eccentric wheel at a rotation setting.

8. The percussive massage device according to claim 1, further comprising a head cover, a rubber guide ring, a rubber press ring, and a housing; a front end surface of the head cover is an open structure, a folded edge is provided at the open structure of the front end surface of the head cover, and the folded edge is inwardly folded relatively to the open structure; a rear end portion of the rubber guide ring is formed with a groove and a convex edge, and a front end portion of the rubber guide ring penetrates out of the front end surface of the head cover from the rear to the front, and the folded edge is inserted into the groove and buckled with the convex edge;

the rubber press ring is arranged behind the rubber guide ring, the head cover, the rubber guide ring and the rubber press ring are fixedly connected, and the head cover, the rubber guide ring, the rubber press ring and the housing are all sleeved on the fixing sleeve tube; the head cover is fixedly connected with the housing.

9. The percussive massage device according to claim 8, wherein an outer wall of the front portion of the base expands outward to form a protruding ring, and a front end surface of the rubber guide ring is snapped on the protruding ring.

* * * * *